United States Patent [19]

Jung et al.

[11] Patent Number: 4,803,781

[45] Date of Patent: Feb. 14, 1989

[54] CUTTING MACHINE FOR FLAT MATERIAL SUCH AS CLOTH, SHEET MATERIAL AND THE LIKE

[75] Inventors: Rolf Jung, Waiblingen; Walter Schweitzer, Ludwigsburg, both of Fed. Rep. of Germany

[73] Assignee: Krauss u. Reichert GmbH & Co. KG Spezialmaschinenfabrik, Fellbach, Fed. Rep. of Germany

[21] Appl. No.: 401,366

[22] Filed: Jul. 23, 1982

[30] Foreign Application Priority Data

Aug. 14, 1981 [DE] Fed. Rep. of Germany ..... 3132127

[51] Int. Cl.[4] ..... B26B 7/00

[52] U.S. Cl. ..... 30/275; 83/925 CC

[58] Field of Search ..... 30/273, 275; 83/925 CC; 414/744 R, 750, 1, 4; 192/129 A, 130; 212/149–153, 188

[56] References Cited

U.S. PATENT DOCUMENTS 4,406,576 9/1983 Inaba et al. ..... 414/735

FOREIGN PATENT DOCUMENTS 2703066 7/1978 Fed. Rep. of Germany .

*Primary Examiner*—Douglas D. Watts

*Attorney, Agent, or Firm*—Shenier & O'Connor

[57] ABSTRACT

A cutting machine for fabrics, comprising a table, a carriage reciprocating along the same, a pivoted cantilever extending above the table and having an inner arm pivotably mounted about a vertical axis on the carriage and an outer arm articulated on the inner arm, a hand cutter being pivotable about a vertical axis on the outer arm, further comprising switching means for the carriage drive and for controlling the direction of travel of the carriage, a first switching means being provided which is controlled by both arms in order to limit the deviations of the angle formed by the two cantilever arms from an angle of 90°, a second switching means controlled by the inner cantilever arm also being provided to limit the deviations of the angle formed by the inner cantilever arm and the direction of travel of the carriage from an angle of 90°. This ensures that when the carriage is started the forces thus occurring at the hand cutter or its guide handle do not interfere with the cutting operation and do not produce any incorrect cuts.

17 Claims, 8 Drawing Sheets

CUTTING MACHINE FOR FLAT MATERIAL SUCH AS CLOTH, SHEET MATERIAL AND THE LIKE

This invention relates to a cutting machine for flat material such as cloth, sheet material or the like, comprising a table to receive the flat material for cutting, a carriage adapted to reciprocate along the table by means of a drive, a pivoted cantilever extending above the table and comprising an inner arm mounted on the carriage to pivot about a vertical axis, and an outer arm connected to the inner arm via a pivot with a vertical pivot axis, a hand cutter being mounted on the outer arm so as to pivot about a vertical axis, further comprising a switching means for switching the carriage drive on and off and for controlling the direction of carriage travel.

In cutting machines of this kind, the carriage is preferably disposed at one longitudinal side of the table so that the pivot axis between the cantilever and the carriage is near one of the table edges. The carriage may alternatively be in the form of a bridge which spans the table and on which the cantilever is articulated. The invention preferably, however, relates to an improvement to a cutting machine of the kind described in German Offenlegungsschrift No. 27 03 066.

Of course the table may be replaced by any other system, e.g. in the shape of a box, having a surface to receive the flat material for cutting.

In a known cutting machine of the kind referred to hereinbefore, a switch by means of which the carriage can be moved to the left or right controlled independently of the position of the cantilever is disposed in the area of the hand cutter which is provided with a handle for guidance. Practice, however, has shown that this frequently causes the hand cutter to deviate from the predetermined cutting direction and position, since the carriage suddenly starting up may result in considerable forces on the hand cutter and hence on the handle. The danger of an incorrect cut would be even greater, however, if the carriage drive were so controlled as always to start automatically when the hand cutter during the cutting operation comes into the boundary area of the cantilever reach (referred to the instantaneous carriage position), since in this case the operator would also be surprised by the carriage starting up.

The object of the invention is so to improve the cutting machines of the kind referred to hereinbefore that when the carriage starts up the forces occurring as a result on the hand cutter and its handle do not interfere with the cutting operation and result in any incorrect cuts. To this end, according to the invention, a switching means is used to start the carriage automatically whenever (or, if required, to allow the carriage drive to be switched on manually only whenever) the cantilever during the cutting operation leaves the optimum position with respect to the carriage for minimum reactive forces onthe hand cutter or its handle, or a predetermined area around such position. The carriage in the cutting machine according to the invention does not therefore start (nor, if requiired, can it be started manually) when the position of the catilever in relation to the carriage as a result of the starting of the latter causes the hand cutter to experience reactive forces such that the hand cutter held by the operator would as a result be moved away from the predetermined cutting direction and position.

This basic idea of the invention can be embodied structurally more particularly by providing a first switching means for the carriage drive to limit the deviations of the angle formed by the two cantilever arms from an angle of 90°, it having been found particularly advantageous to allow deviations only of the order of ± approximately 20°.

Advantageously, in order to avoid any incorrect behaviour of the carriage drive control for all imaginable positions and directions of movement of the hand cutter and cantilever arm configurations, a second switching means is provided for the carriage drive to limit the deviations of the angle formed by the inner cantilever arm and the direction of carriage travel from an angle of 90°, it having been found particularly advantageous to allow only deviations of the order of ± approximately 40°. The problem referred to can alternatively be obviated by providing a second switching means for the carriage drive, said second switching means being controllable in dependence on the angle between the inner cantilever arm and the direction of carriage travel, so adapting the length of the cantilever arms, table width and switching thresholds of the two switching means to one another that the length of the extended cantilever is greater than the table width so that the hand cutter could be moved beyond one of the longitudinal edges of the table, and on movement of the hand cutter along the table edge opposite the carriage in the direction of the table length extending from the bent cantilever the switching threshold associated with this direction is reached for the second switching means before the first switching means is actuated.

To enable the cantilever to be changed from a first configuration with the cantilever arms forming an acute or obtuse angle, to a second configuration in which the angle formed by the cantilever arms points in the opposite direction, without the carriage undesirably continuing to travel during this pivoting of the outer cantilever arm, it is advantageous so to construct the two switching means that they are both actuated when the cantilever is at least approximately in the extended position and the carriage drive is thus switched off. The term "substantially extended cantilever" in this context means that the two cantilever arms together form an angle of 180° ± approximately 20° or 30°.

The circuitry used for the switching means may be any known devices, e.g. photoelectric cells etc.; to ensure that operation is carried out with the minimum malfunctioning, however, it is advantageous for the switching means to comprise cams and cam-actuated mechanical switches pivotable relatively to one another.

A better solution of the problem in a preferred embodiment of the cutting machine according to the invention is to provide the carriage drive with a control means for smooth starting. It is particularly advantageous to use a known phase sequence control which automatically runs up to speed.

For the same reason, in this preferred embodiment the control means is so constructed that when the carriage drive is switched off the carriage speed is reduced slowly—a function which can be guaranteed by the same phase sequence control.

Advantageously, in a cutting machine according to the invention, a switch for actuating the carriage drive is disposed in the area of the hand cutter handle so that the carriage drive cannot be started by its automatic control until the operator has taken hold of the hand cutter handle and actuated the said switch.

In the case of cutting machines with relatively long tables, in particular, it is extremely tedious so to adjust these tables that they extend exactly horizontally. If this is not done, the hand cutter may run away with the blade switched on and pivot the cantilever when the operator releases the hand cutter handle. To obviate this, the invention proposes that at least one of the pivots between the carriage and the hand cutter should be provided with a locking means and that the hand cutter should be provided with a switch releasing the locking means, said switch advantageously being disposed in the area of the hand cutter handle. A mechanically actuated switch may advantageously be replaced by a proximity switch or the like, incorporated, for example, in the hand cutter handle and therefore being actuated, but without force, when the operator takes hold of the handle, so that only then can the locking means be released and the cantilever and/or hand cutter be pivoted. Since the known hand cutters rest on the table by a baseplate provided with rigidly mounted rollers, which have a strong directional effect, only a single brake has to be provided at the pivot between the cantilever and the carriage, since if the directionally stabilized hand cutter rolls away unintentionally as a result of an inclination of the table the cantilever would always pivot, and this can be prevented by the said brake.

Other features, advantages and details of the invention will be apparent from the following description and the accompanying drawings of one preferred embodiment of the cutting machine according to the invention. In the drawings.

Figure 1:
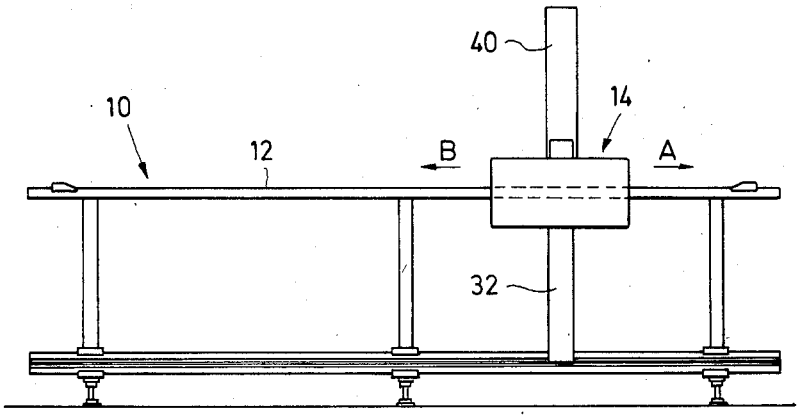
FIG. 1 is a side elevation of the cutting machine looking at the side on which the carriage is disposed.

The general construction of the cutting machine will first be explained by reference to FIGS. 1, 2 and 4.

It comprises a table 10 with a tabletop 12 to receive the flat material for cutting, and a carriage, which is denoted by a general reference 14, bears a hand cutter 18 at the end of a cantilever 16, and is adapted to reciprocate in the direction of arrows A and B in FIGS. 1 to 4 in parallel relationship to one longitudinal edge of the table.

Figure 2:
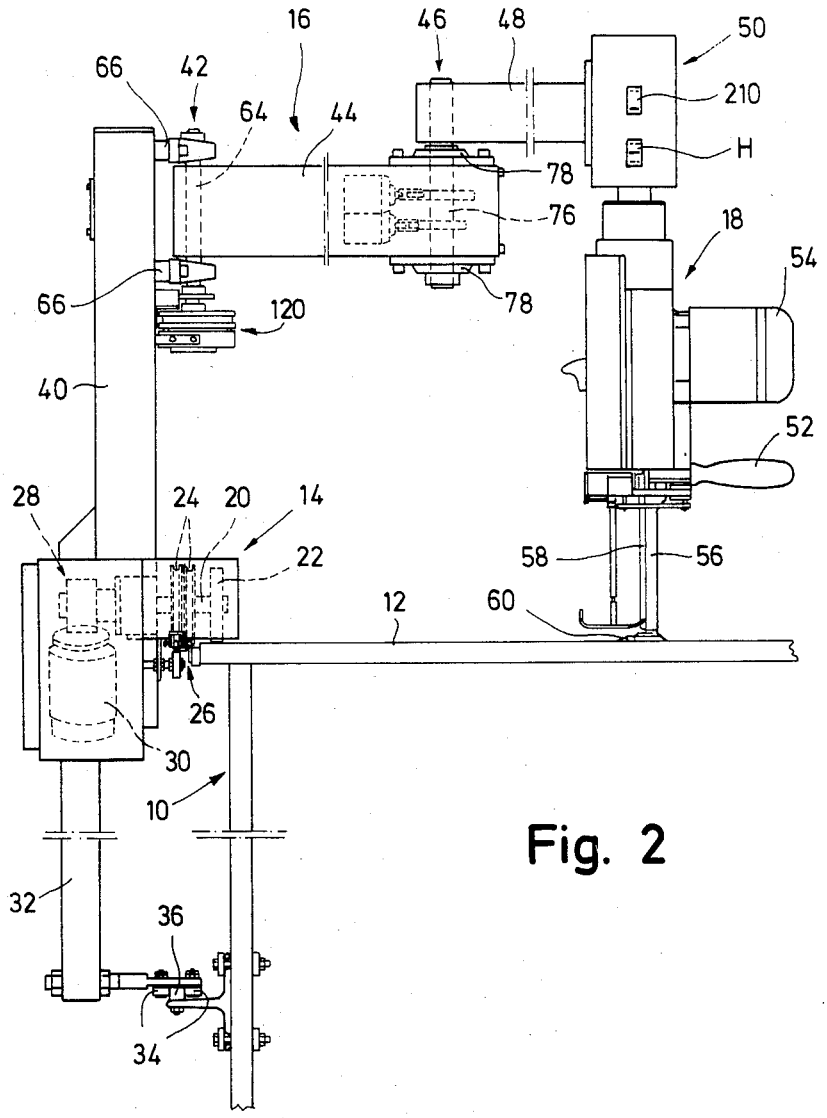
FIG. 2 is a side elevation of part of the cutting machine with the carriage, cantilever and hand cutter viewed in the direction of travel of the carriage.

The carriage 14 has two axles disposed consecutively in the direction of travel, one of the axles, 20, being shown in broken lines in FIG. 2. Each of these axles bears an outer running wheel 22, which bears on the top of the tabletop 12, and track wheels 24 bearing on a rail system 26 secured laterally to the tabletop 12 and extending in the longitudinal direction of the table. One of the axles is driven by an electric motor 30 through a bevel gear 28. The rail system 26 may be provided with teeth or perforations in which a gearwheel driven by the electric motor 30 engages to obviate slip between the drive and the rail system 26. Carriage 14 also has a downwardly extending post 32 on which two supporting rollers 34 are rotatably mounted and enclose between them a support rail 36 fixed to the frame of the table 10 and extending in the longitudinal direction of the table.

Carriage 14 is also provided with an upwardly extending column 40 which bears the cantilever 16 via an inner pivot 42 having a vertical pivot axis. An inner arm 44 of the cantilever 16 is articulated here and bears an outer arm 48 of the cantilever 16 via a central pivot 46 also having a vertical pivot axis. A known pivot system 50 not shown in detail is provided at the outer end of arm 48 and allows vertical adjustment of the hand cutter 18 and its rotation about a vertical pivot axis.

Except for the construction of a guide handle 52 fixed on the cutter housing, the hand cutter is basically conventionally constructed as a straight blade machine and comprises an electric drive motor 54, a support 56 forming a vertical guide for a vertically oscillating blade 58, and a base plate 60 secured to the bottom end of the support 56 and enabling the cutter 18 to rest on the tabletop despite the fact that the weight is taken by the pivot system 50.

Figure 8:
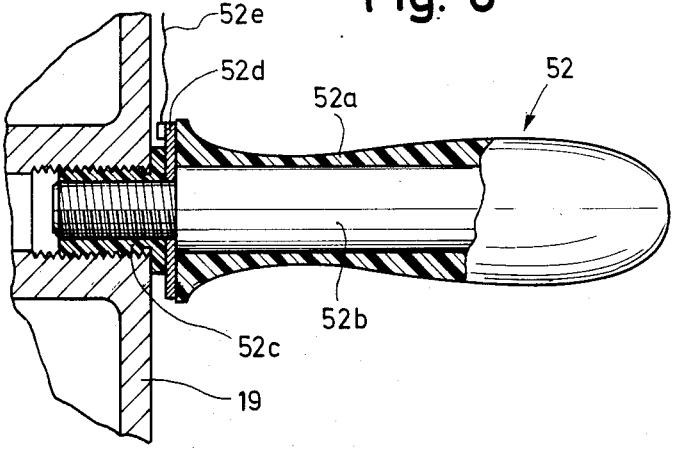
FIG. 8 is a section through the guide handle of the hand cutter.
Figure 4:
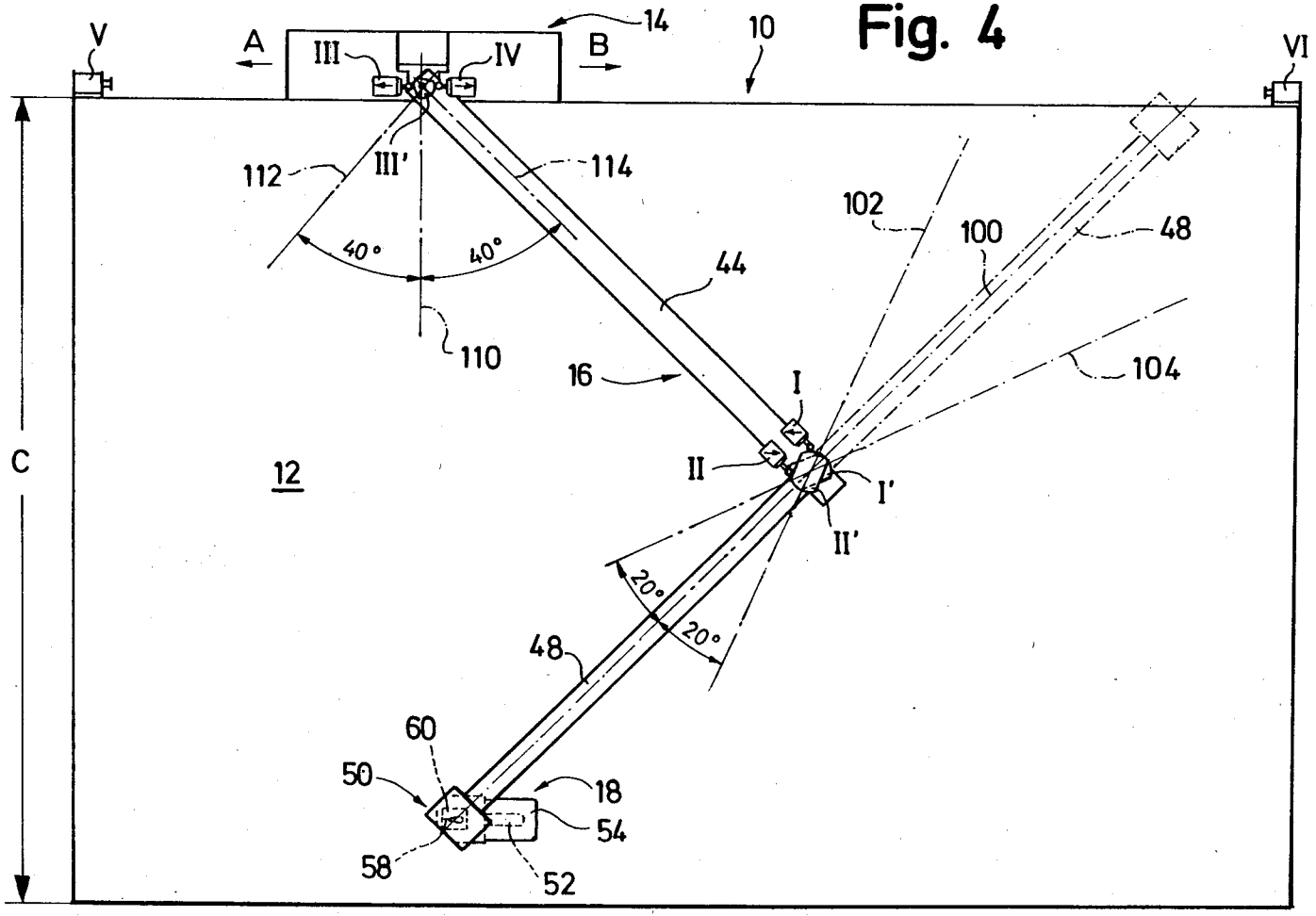
FIG. 4 is a plan view of the cutting machine.

In the region of the handle 52, the cutter 18 has a switch 206, which is shown only in FIG. 9, for switching the drive motor 54 for the blade 58 on and off, a switch H for controlling the drive for the carriage 14 so that it can be moved to the right or left by hand control as shown in FIG. 4, and, according to the invention, in the handle 52 a switch shown in FIG. 8, by means of which, in the automatic mode explained hereinafter, the carriage 14 and the parts of the cantilever 16 can move only when the operator of the cutter 18 is holding its handle 52. This will be discussed in detail hereinafter.

Figure 3:
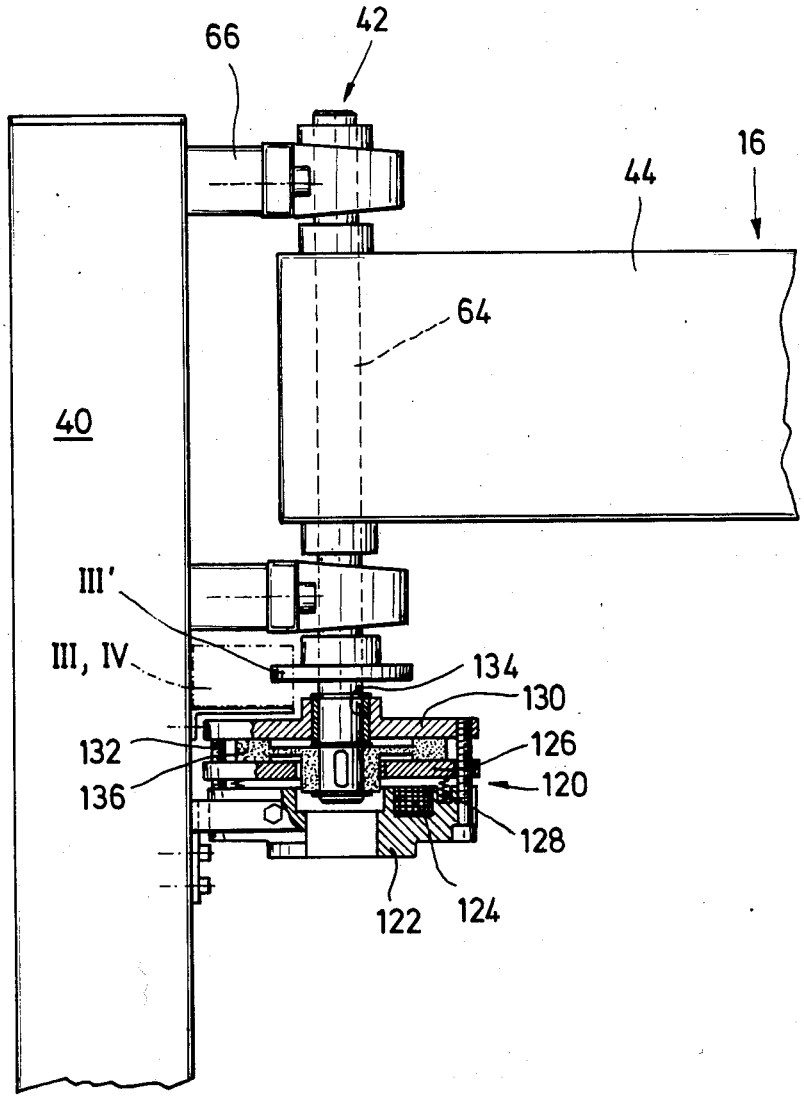
FIG. 3 shows the top of a column disposed on the carriage and the inner part of the cantilever to a larger scale than in FIG. 2 and with a brake shown in section.

The inner pivot 42 of the cantilever 16 has a shaft 64 secured to the arm 44, said shaft being held rotatably and so as to be axially non-slidable in bearing brackets 66 secured to the column 40 (see FIGS. 2 and 3). A cam III' is fixed on the shaft and co-operates with switches III and IV fixed on the column 40, and as will be seen more particularly from FIGS. 5 and 6 these switches are mechanical cam follower switches and comprise a plunger 70 which can be actuated by a pivotable switching arm 72 articulated on the switch housing. A camming roller 74 is mounted rotatably in this arm and follows the cam III rotating with the shaft 64.

The middle pivot 46 of the cantilever 16 is also provided with a shaft 76 which is secured on the outer arm 48 and is held rotatably but axially non-slidably in bearings 78 of the inner arm 44. Cams I' and II' are fixed on the shaft one above the other and co-operate with switches I and II fixed in manner not shown in detail on the inner canilever arm 44. These switches are also cam switches like the switches III and IV.

Finally, limit switches V and VI are fixed on the tabletop 12 and co-operate with the carriage 14 and switch off its drive when the carriage reaches one of the table ends.

According to the invention, the cams I' and II' and the switches I and II are so constructed and disposed that the outer cantilever arm 48 can be pivoted through an angle of the order of 20° in either direction from the two middle positions 100 shown in FIG. 4 without the drive for the carriages 14 being switched on; the switching thresholds defined by the switches I and II and by the cams I' and II' are denoted by references 102 and 104 in Fig IV. The middle positions 100 of the outer cantilever arm 48 are distinguished by the fact that in these positions the two cantilever arms 44 and 48 include a right angle. If the outer cantilever arm 48 is pivoted in the clockwise direction in relation to the inner arm 44, the cam II' and switch II switch the carriage 14 to right-hand travel (arrow B) when threshold 104 has been reached, so as to increase or reduce the angle formed by the cantilever arms 44, 48, while when the outer arm 48 is pivoted in the anti-clockwise direction in relation to the inner arm 44 the can I' together with the switch I switches the carriage drive to left-hand travel (arrow A) when threshold 102 is reached so that the angle enclosed by the arms 44, 48 is again reduced or enlarged as the case may be.

Figure 5:
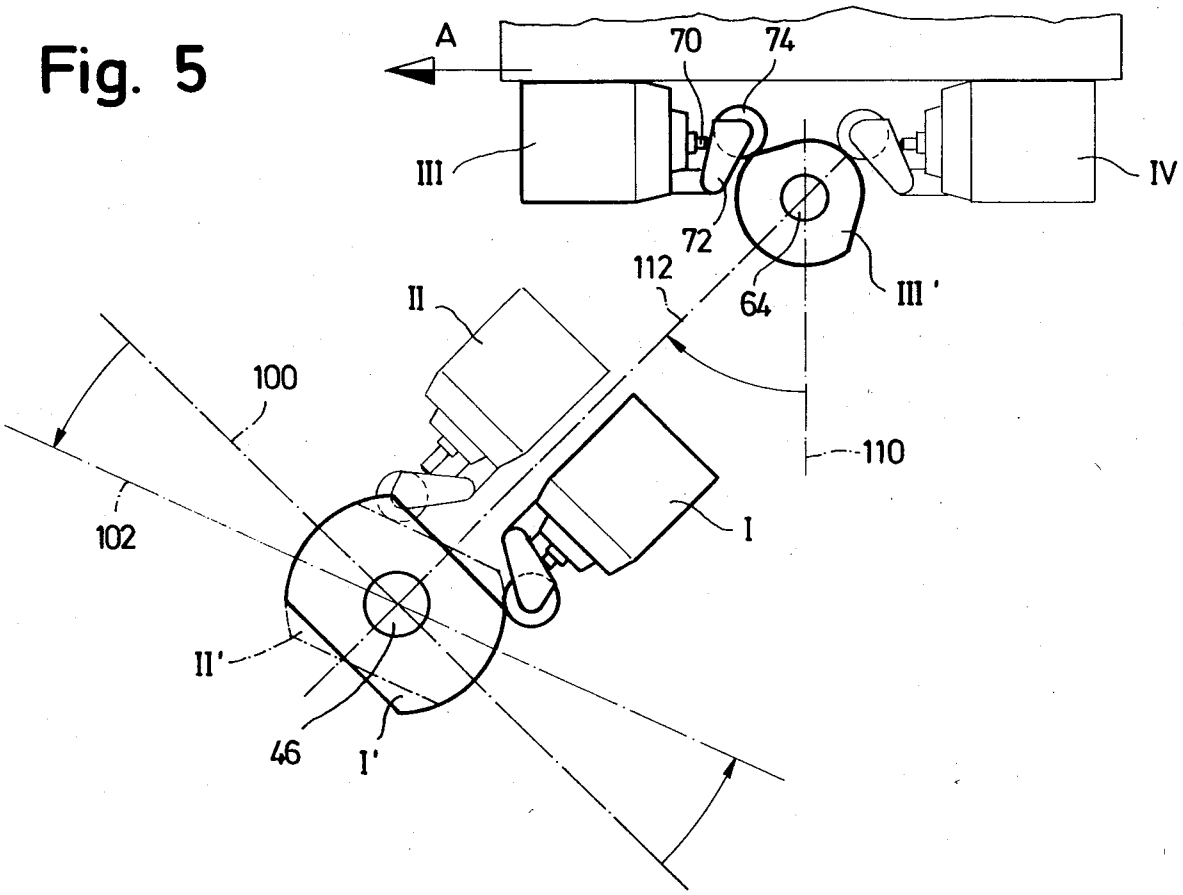
FIG. 5 is a diagrammatic plan view of the two switching means in a first boundary position of the cantilever arms.
Figure 6:
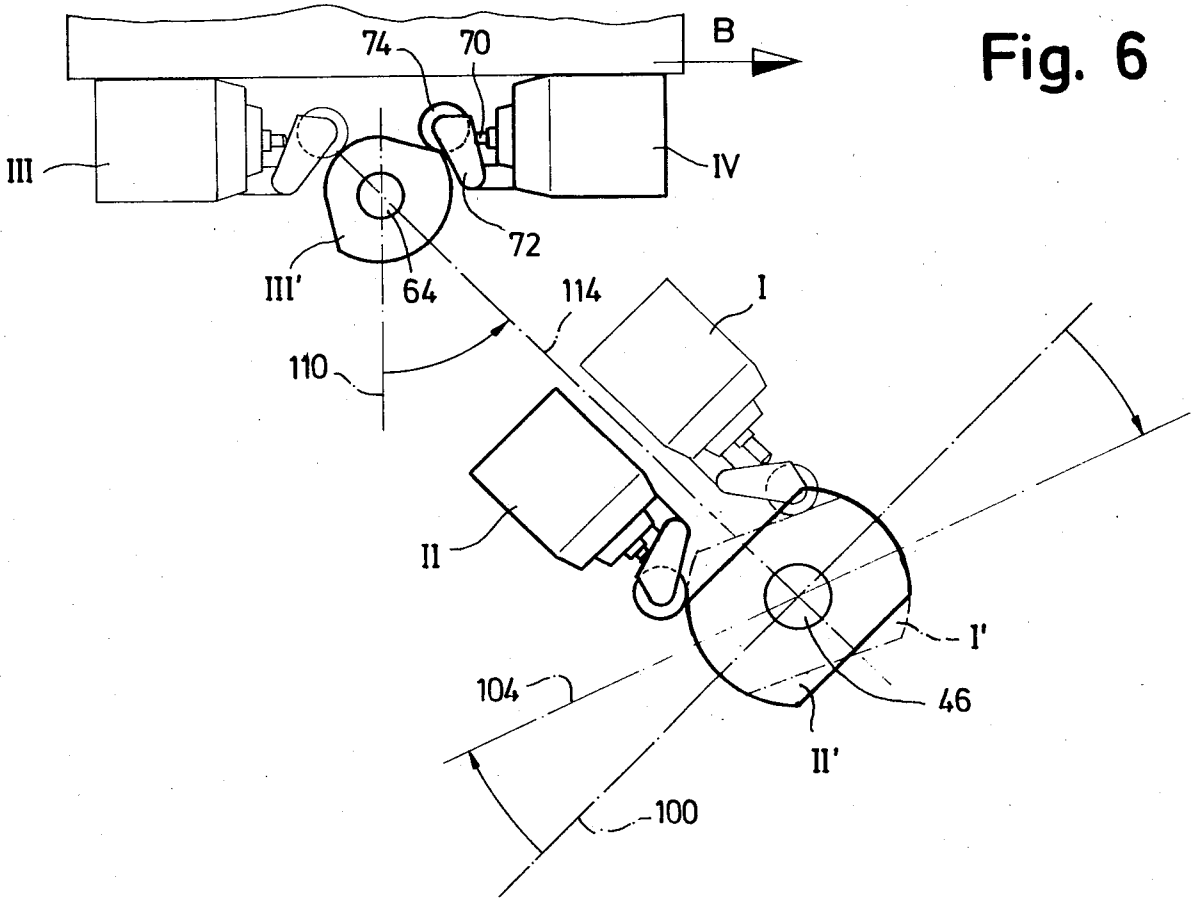
FIG. 6 is a similar view to FIG. 5 with the cantilever arms in a second boundary position.
Figure 7:
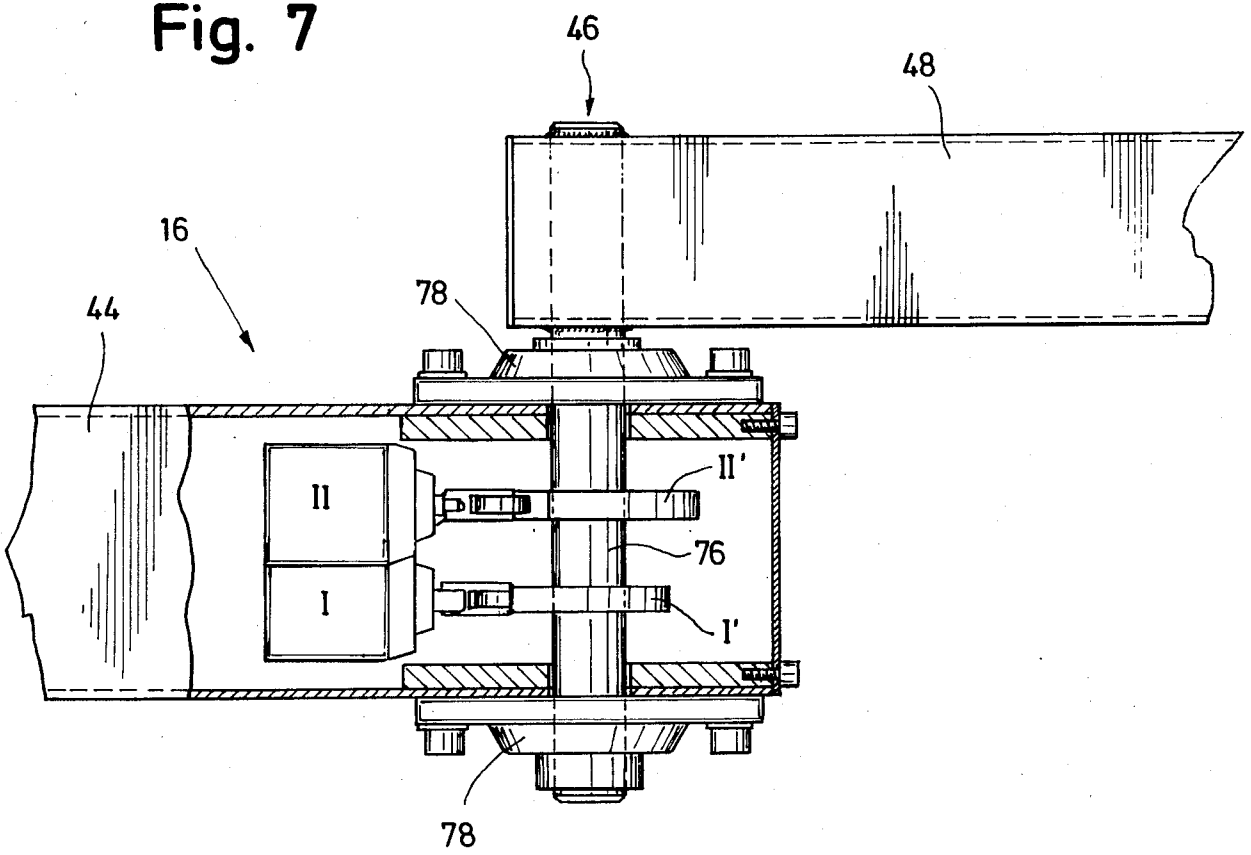
FIG. 7 is a section through the middle pivot of the cantilever to show the second switching means.

The control circuit for the drive for the carriage 14 is controlled in the same way by the switches III and IV in conjunction with the cam III'. With regard to the effect of the carriage 14 on the cutter 18, ideal conditions are obtained when the inner arm 44 assumes a middle position 110 in which it includes an angle 90° with the direction of travel of the carriage 14 (arrow A or arrow B). Starting from the middle position 110, the inner arm 44 can be pivoted in either direction through an angle of the order of 40° without the carriage drive being automatically switched on. When, however, the inner arm 44 reaches position 12 in relation to carriage 14 during pivoting in the clockwise direction, this position being the left-hand travel threshold, the switch III and cam III' switch the drive for the carriage 14 to left-hand travel (arrow A) while when the arm 44 is pivoted out of the middle position in the anti-clockwise direction the carriage drive is switched to right-hand travel (arrow B) when the inner arm 44 reaches the position 114 (right-hand travel threshold). In FIGS. 5 and 6, the positions introducing left-hand travel (arrow A in FIG. 5) and right-hand travel (arrow B in FIG. 6) are shown separately, the operative cams and switches in each case being shown in thicker lines.

FIG. 3 shows an electromagnetic brake 120 for locking the inner pivot 42 of the cantilever 16. It comprises an electromagnet 124 in a housing 122 fixed to the column 40, said electromagnet acting on an armature disc 126 movable in the direction of the axis of the shaft 64 when energized, when it pulls this armature disc down out of the position shown in FIG. 3 against the action of compression springs 128 bearing on the housing 122. An abutment washer 130 is fixed to the housing 122 with a set of screws 32 and has a bearing 134 in which shafts 64 rotates. The bottom end of shaft 64 is connected to a driver washer 136 so as to rotate therewith, so that the latter can be moved axially along the shaft 64. The armature disc 126, however, is prevented from co-rotation because the screws 132 pass through it.

If the electromagnet 124 is not energized, the driver washer 136 is clamped by the compression springs 128 between the abutment washer 130 and the armature disc 126 so that the shaft 64 cannot rotate and hence the inner cantilever arm 44 fixed to this shaft cannot be pivoted. When the electromagnet 124 is energized, however, it pulls the armature disc 126 down so that the shaft 64 and hence the inner cantilever arm 44 are no longer locked.

The locking mechanism formed by the electromagnetic brake 120 is controlled by a safety switch accommodated in the guide handle 52 of the cutter 18 and constructed in the form of a switch controllable without physical contact, consisting basically of a plastics outer shell **52*a* and a metal core 52*b* fixed on the cutter housing 19 so as to be electrically insulated by means of an insulating bush 52*c* and—as is conventional in capacitive switches controllable without physical contact—forming one side of a capacitor so that its capacity can be varied when an operator places his or her hand around the outer shell 52*a* of the handle 52. The metal core 52*b* is connected via metal washer 52*d* and a lead 52*e* to the control circuit of the cutting machine according to the invention, which will be explained hereinafter with reference to FIG. 9**.

The control circuit according to the invention for the drive motor 54 for the cutter 18, the electric motor 30 for the carriage 14, and the electromagnetic brake 120 for the inner cantilever pivot 42 comprises, firstly, a main switch 200 by means of which it can be connected to the three phases R, S and T, a neutral conductor Mp and a protective conductor SL of a polyphase cable. The leads run from this main switch to a chassis 202 containing a power pack 204 to produce a 24V d.c. voltage. The places on this chassis which are connected to the d.c. positive and negative terminals of the power pack are denoted by references (+) and (−). The drive motor 54 for the blade 58 for the cutter 18 is permanently connected to the protective conductor SL and can be connected to the phases R, S, T via the hand switch 206 provided in the area of the handle 52 on the cutter 18. A set 208 of slip-ring contacts disposed in the pivot system 50 at the end of the cantilever 16 is situated in front of this hand switch.

A mode switch 210 (see also FIG. 2) is disposed above the hand cutter 18 and provides selection between manual and automatic modes of operation. In the first mode the electric motor 30 of the carriage 14 can be switched on and off by means of a manual control travel switch H disposed next to the mode switch 210, by means of a contact H1 for left-hand travel (arrow A in FIG. 4) and a contact H2 for right-hand travel (arrow B in FIG. 4) as will be clear from the following explanation. If the mode switch 210 is open as shown in FIG. 9, the control is in the manual mode and the hand control travel switch H is operative while when the mode switch 210 is closed the +24V is connected to a line 212 of the chassis 202.

The locking switch incorporated in the guide handle 62 and described with reference to FIG. 8 has the reference 214 in FIG. 9. As already stated, this is advantageously a capacitative proximity switch, the mode of operation of which is well known and which is connected to +24V on the one hand and, on the other hand, to a line 216 on the chassis 202 via one of the slip-ring contacts of the set 208. As long as the operator is holding the handle 52, the line 216 is accordingly at +24V. This line leads via an amplifier 218 to the electromagnetic brake 120 so that its magnet is always energized and makes the brake in operative for as long as the operator is holding the handle 52.

Line 212 leads to an amplifier 220, the output of which is connected to a known phase sequence control 222. By way of a line 224 this controls a thyristor 226 and is so constructed in known manner that when the electric motor 30 is switched on it makes the same rotate slowly at first and then at an increasing speed, by means to be described hereinafter. Conversely, the electric motor 30 runs down slowly when switched off. The amplifier 220 should be so constructed as to be operative when mode switch 210 is closed, i.e. is in the automatic mode position.

A line 228 branches from line 212 and, like line 216, leads to an inverter 230 and 232, the outputs of which are combined at a NOR gate 234. This logic circuit ensures that switches I, II, III and IV can be operative only when the mode switch 210 is set to automatic mode and the operator is actuating the locking switch 214 by holding the handle 52.

The output of inverter 230 is connected via line 236 to the input of an amplifier 238, the output of which is connected to the phase sequence control 222. Amplifier 238 is so constructed that in conjunction with the inverter 230 it ensures that the electric motor 30 of the carriage 14 is operated via the amplifier 238 when the mode switch 210 is in the manual mode position. Advantageously, the amplifiers 220 and 238 are so dimensioned in relation to one another that the speed of travel of the carriage 14 in manual operation via amplifier 238 is greater than in automatic operation via the amplifier 220.

The switches I, II and III are all constructed as two-way switches. Switch III has a normally-open contact in a line 252 connecting line 250 via line 254 to an amplifier 256 for left-hand travel of the carriage 14, and a normally-closed contact in a line 253, connecting the line 250 via a line 258 to the input of an amplifier 260 for the right-hand travel of carriage 14. Switch II has a normally-open contact in line 253 downstream of the normally-closed contact of switch III and after the normally-open contact of switch II. Finally, line 253 also contains a normally-closed contact of switch I. A line 255 connecting line 250 to line 258 contains only one normally-open contact of switch IV while a line 257 connecting line 250 to line 254 contains a normally-closed contact of switch IV followed by a normally-closed contact of switch II and a normally-open contact of switch I.

The +24V can alternatively be applied optionally to lines 254 and 258 by closing one of the contacts H1 an H2 of the manual control travel switch H.

Figure 9:
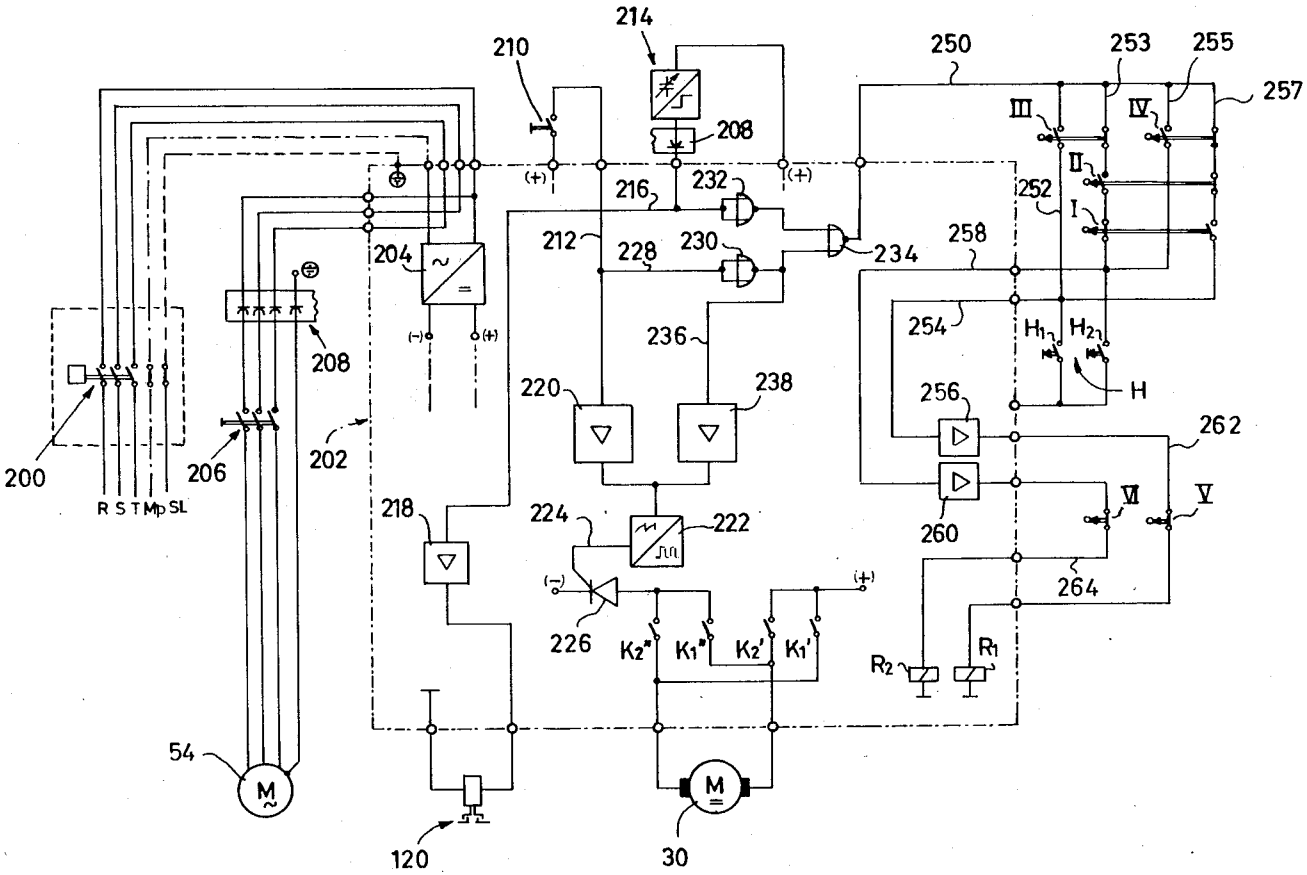
FIG. 9 is a block schematic of the electrical control system of the cutting machine according to the invention.

The lines 262 and 264 containing normally-closed limit switches V and VI lead from the outputs of amplifiers 256 and 260 to the windings R1 and R2 of two relays, of which the first relay containing the winding R1 has normally-open contacts K1′ and K1″ while the second relay with the winding R2 contains normally-open contacts K2′ and K2″; the electric motor 30 can be set to right-hand or left-hand travel controlled as shown in FIG. 9 by way of these normally-open contacts of the two relays.

If mode switch 210 is open, i.e. the control according to the invention is in the manual mode, and if the locking switch 214 has been closed by taking hold of the handle 52, line 250 is dead. If, however, contact H1 of the manual control travel switch H is closed, relay winding R1 pulls up so that the normally-open contacts K1′ and K1″ of the first relay are closed. The right-hand side of the electric motor 30 with reference to FIG. 9 is then connected to the negative terminal and the left-hand side is connected to the positive terminal of the power pack 204, so that carriage 14 is moved to the left (arrow A in FIG. 4).

If, however, contact H2 of manual control travel switch H is closed, line 258 is connected to the +24V and the winding R2 of the second relay pulls up and its normally-open contacts K2′ and K2″ are closed. The right-hand side of the electric motor 30 is then connected to the positive terminal and the left-hand side to the negative terminal of the power pack 204 so that the carriage 14 moves to the right (arrow B in FIG. 4).

In the automatic mode (mode switch 210) and with the handle 52 held by the operator (locking switch 214) line 250 is connected to the +24V so that the switches I, II, III and IV can come into operation.

If the inner cantilever arm 44 is pivoted in the clockwise direction until reaching the threshold 112 for the left-hand travel (see FIG. 4) switch III is actuated, resulting in its left-hand contact with reference to FIG. 9 being closed and its right-hand contact being opened. Line 254 is then connected to the +24V, and this has the same effect as closing the contact H1, i.e. carriage 14 moves to the left. According to the invention, no other function can be initiated by pivoting of the outer cantilever arm 48 since the line 253 always remains broken by the open normally-closed contact of switch III, while the normally open contact of switch IV in line 255, when the switch is not actuated, prevents the +24V reaching the line 258, and finally actuation of switch I would only have the same result as actution of switch III, i.e. application of the +24V to the line 254.

If the inner cantilever arm 44 is pivoted in the counter-clockwise direction referring to FIG. 4 until reaching the right-hand travel threshold 114, switch IV is actuated so that line 258 is connected to a +24V as a result of its normally-open contact in line 255 closing. Since the normally-closed contact of switch IV, which is now open, keeps the line 257 open in every case and the switch III is not actuated, so that its normally-open contact breaks the line 252, pivoting of the outer cantilever arm 48 in any direction cannot initiate any function other than movement of the carriage 14 to the right (arrow B) in FIG. 4.

If the outer cantilever arm 48 is pivoted in the anti-clockwise direction until reaching the left-hand travel threshold 102 (see FIG. 4), switch I is actuated and closes the line 257, with the same result as closure of contact H1, i.e. carriage 14 moves to the left (arrow A in FIG. 4).

If, however, the outer cantilever arm 48 is pivoted in the clockwise direction until reaching the right-hand travel threshold 104, switch II is actuated and, since the normally-closed contacts of switches I and II are closed, closes the line 253 and applies +24V to line 258. The result is the same as closure of switch H2, i.e. carriage 14 moves to the right (arrow B in FIG. 4).

As a result of the phase sequence control 222, carriage 14 stops slowly on reopening of whichever contact of the travel switch H or of switches I to IV had initiated the previous travel condition of the carriage 14—in the case of the automatic mode, the electric motor 30 for driving the carriage 14 is thus stopped slowly when the cantilever arms 44, 48 return to the permissible angle zones as a result of a change of position of the carriage 14.

In the preferred embodiment of the cutting machine according to the invention, the sum of the lengths of the cantilever arms 44 and 48 is greater than the width C of the tabletop 12 (see FIG. 4). The switching thresholds 102, 104, 112, 114 have also been so selected that with the cantilever arm configuration shown in solid lines in FIG. 4 the switch IV is actuated before switch I when the cutter 18 is moved to the right along that longitudinal edge of tabletop 12 which is remote from the carriage 14. This is advantageous because otherwise the carriage might travel in the wrong direction in this extreme situation. The angle between the cantilever arms 44 and 48 should, of course, be as close as possible to 90°; when the cutter 18 is moved to the right this angle is increased and when switch I is actuated in this extreme situation carriage 14 moves to the left (arrow A) so that the angle between the cantilever arms increases further.

According to another feature of the invention the cams I' and II'' are so devised that the switches I and II are both actuated when the cantilever 16 is extended or substantially extended (angle formed by cantilever arms ± approximately 20°). Since in this condition line 253 is broken by switch I and line 257 is broken by switch II, carriage 14 remains stationary. One of the results of this step is that arm 48 can be brought into the broken-line position in FIG. 4 by rapid pivoting or, in general terms, the configuration of the cantilever arms can be reversed without having an adverse effect on carriage movements.

Finally, according to the invention, the switching thresholds of the switching systems I, II, I', II', III, IV, III' can also be rendered inoperative by moving the carriage 14 to one of the limit switches V, VI.

Having thus described our invention, what we claim is:

1. A cutting machine for flat material such as cloth, sheet material and the like comprising a table for receiving the flat material to be cut, a carriage, means mounting said carriage for reciprocating movement along said table, a drive for moving said carriage, a cantilever, means mounting said cantilever for pivotal movement on said carriage with said cantilever extending above said table, said cantilever comprising an inner arm mounted on the carriage for pivotal movement about a vertical axis and an outer arm connected to the inner arm by a pivot having a vertical pivot axis, a cutting apparatus mounted on the outer arm for pivotal movement about a vertical axis, and means for switching the carriage drive on and off for controlling the direction of carriage travel, said switching means comprising a first automatic switching means for controlling the carriage drive for limiting the deviations of the angle formed by said inner and outer cantilever arms from an angle of 90°.

2. A cutting machine according to claim 1 in which said automatic switching means comprises a second switching means for controlling the carriage drive to limit the deviations of the angle formed by said inner cantilever arm and the direction of carriage travel from an angle of 90°.

3. A cutting machine according to claim 1 in which said switching means comprises a second switching means for controlling the carriage drive in accordance with the angle between the inner cantilever arm and the direction of carriage travel, the relationship between the lengths of the inner and outer cantilever arms and the table width and the switching thresholds of the first and second switching means is such that the length of the extended cantilever is greater than the table width and such that on movement of the cutting apparatus along the table edge opposite the carriage in the direction in which the bent cantilever is pointing the switching threshold of said second switching means associated with this direction, is reached before actuation of said first switching means.

4. A cutting machine according to claim 2 or 3, in which when the cantilever is in the at least substantially extended position said first and second switching means are actuated to switch off the carriage drive.

5. A cutting machine according to claim 1 in which the first switching means responds when the angle formed by the two arms deviates from 90° by more than approximately 20°.

6. A cutting machine according to claim 2 in which the second switching means responds when the angle formed by the cantilever and direction of carriage travel deviates from 90° by more than approximately 40°.

7. A cutting machine according to claim 1 in which the carriage drive is provided with a control means for smooth starting.

8. A cutting machine according to claim 7 in which the construction and arrangement of said control means is such that when the carriage drive is switched off the carriage speed is reduced slowly.

9. A cutting machine according to claim 1 including a handle disposed on the cutting apparatus, a switch for actuating the carriage drive and means mounting said switch in the area of said handle.

10. A cutting machine according to claim 1 in which at least one of the pivots between the carriage and the cutting apparatus is provided with a locking means and the cutting apparatus is provided with a switch which releases the locking means.

11. A cutting machine according to claim 10 in which said switch is disposed in the area of the handle of the cutting apparatus.

12. A cutting machine according to claim 9 or 10 in which said switch is constructed as a proximity switch.

13. A cutting machine according to claim 10 or 11 including a single brake disposed on the pivot between the carriage and the cantilever.

14. A cutting machine according to claim 15 or 16 in which said cam is so adjustable relatively to its associated switch that the pivot angle at which the switch responds is adjustable by this means.

15. A cutting machine according to claim 1 in which said first switching means comprises a cam and a pivotable cam actuated switch.

16. A cutting machine according to claim 2 in which said second switching means comprises a cam and a pivotable cam actuated switch.

17. A cutting machine for flat material such as cloth, sheet material and the like comprising a table for receiving the flat material to be cut, a carriage, means mounting said carriage for reciprocating movement along said table, a drive for moving said carriage, a cantilever, means mounting said cantilever for pivotal movement on said carriage with said cantilever extending above said table, said cantilever comprising an inner arm mounted on the carriage for pivotal movement about a vertical axis and an outer arm connected to the inner arm by a pivot having a vertical pivot axis, a cutting apparatus mounted on the outer arm for pivotal movement about a vertical axis, and means for switching the carriage drive on and off for controlling the direction of carriage travel, said switching means comprising an automatic switching means for controlling the carriage drive to limit the deviations of the angle formed by said inner cantilever arm and the direction of carriage travel from an angle of 90°.

* * * * *